US007767634B2

(12) United States Patent
Mishra et al.

(10) Patent No.: US 7,767,634 B2
(45) Date of Patent: Aug. 3, 2010

(54) LUBRICATING GREASE COMPOSITION

(75) Inventors: Gopal Swaroop Mishra, Mumbai (IN); Paramsivam Senthivel, Mumbai (IN); Suresh Chandra Nagar, Mumbai (IN); Anoop Kumar, Mumbai (IN); Kanta Prasad Naithani, Mumbai (IN); Ravinder Kumar Malhotra, Mumbai (IN); Ram Prakash Verma, Mumbai (IN); Brij Mohan Bansal, Mumbai (IN)

(73) Assignee: Indian Oil Corporation Limited, Mumbai (IN)

( * ) Notice: Subject to any disclaimer, the term of this patent is extended or adjusted under 35 U.S.C. 154(b) by 1076 days.

(21) Appl. No.: 11/471,945

(22) Filed: Jun. 21, 2006

(65) Prior Publication Data

US 2007/0129267 A1 Jun. 7, 2007

(30) Foreign Application Priority Data

Dec. 5, 2005 (IN) ..... 1501/MUM/2005

(51) Int. Cl.

| | |
|---|---|
| ***C10M 117/00*** | (2006.01) |
| ***C10M 113/08*** | (2006.01) |
| ***C10M 129/38*** | (2006.01) |
| ***C10M 139/30*** | (2006.01) |

(52) U.S. Cl. ..... 508/512; 508/165; 508/535

(58) Field of Classification Search ..... 508/512, 508/165, 535

See application file for complete search history.

(56) References Cited

U.S. PATENT DOCUMENTS

| | | | | |
|---|---|---|---|---|
| 2,062,346 | A | 12/1936 | Zimmer et al | |
| 2,209,500 | A | 7/1940 | Zimmer et al | |
| 2,332,247 | A | 10/1943 | Morway et al | |
| 2,379,245 | A | 6/1945 | Morway et at | |
| 3,223,633 | A | 12/1965 | Morway et al | |
| 3,595,789 | A | 7/1971 | Coshburn, Jr. | |
| 3,620,975 | A | 11/1971 | Polishuk | |
| 5,387,351 | A | 2/1995 | Kumar et al. | |
| 5,783,528 | A * | 7/1998 | Rodenberg | 508/200 |
| 6,172,012 | B1 * | 1/2001 | Kumar et al. | 508/165 |

* cited by examiner

*Primary Examiner*—Glenn Caldarola
*Assistant Examiner*—Jim Goloboy
(74) *Attorney, Agent, or Firm*—Ladas & Parry LLP

(57) ABSTRACT

Lubricating grease compositions have a titanium complex grease component along with a mineral/synthetic oil-based component and a conventional soap or grease. The conventional soaps and greases may be lithium complex, calcium sulfonate, or aluminum complex-based, among others, with and without additives. The compositions are high performance geases, exhibiting improved drop point, extreme pressure, antiwear, oil separation, and shelf life properties.

1 Claim, No Drawings

LUBRICATING GREASE COMPOSITION

FIELD OF INVENTION

This invention relates to the development of mixed base complex greases in which a titanium complex grease is one component and a lithium, aluminum complex, sulphonate complex, clay or lithium complex grease is the other component, along with optional additives. A novel process for preparing these greases is also disclosed, which gives synergistic effect in physico-chemical and performance characteristics to the greases. The greases of the invention have been observed to exhibit improved shelf life, in high temperature application, extreme pressure, and anti-wear properties.

BACKGROUND OF THE INVENTION

Metallic soaps, their complex soaps and mixed soaps of Na—Al, or Li—Ca have generally been reported in the prior art as thickeners in the lubricating grease industry. Use of a mixed base soap is an upcoming trend. The use of mixed soaps provides added advantages in actual application areas because of the mixed characteristics of both the soaps.

Polishuk, in 'Brief History Of Lubricating Greases' describes different types of mixed base greases viz, Al—Ca, Al-complex-clay base, Ba—Al base, Al-complex-Na base, Ca—Al, Ca—Pb, Li—Ca. See also U.S. Pat. Nos: 2,379,245; 2,332,247; 2,209,500; and 3,595,789. Some of the mixed base greases prepared by many researchers did not obtain commercial appreciation; this may be due to incompatibility of the two soaps, an antagonistic effect of the two different soaps, or other reasons. Polishuk reported in U.S. Pat. No. 3,620,975 the preparation of an Al-complex-clay base grease for passenger car applications which consists of 2.1% stearic acid, 1.2% benzoic acid, 5% of a derivative of Al-alkoxide, 1% baragel clay, and additives. This grease was reported to perform better in wheel bearing application. Zimmer and Morway (U.S. Pat. No. 2,062,346) prepared a Ca—Al base grease by use of 12% Ca-soap, 10-15% Al-soap, 1% glycerine and mineral oil (300 SUS @ at 100° F.) and reported it to be improved in adhesive and water resistant properties. Morway and Ramsden (U.S. Pat. No. 3,223,633) reported Li—Ca greases for channeling applications which was of 4.1% LiOH, 15% hydrofol acid 51, 2% hydrated lime, 3.0% azelaic acid, and 3.0% acetic acid. This grease was reported to have an ASTM penetration of 245 and a drop point over 450° F. Over a period of time Li—Ca base greases have become more popular, probably because of their excellent water resistance characteristics and other commercial reasons.

It is found interesting to note that, a majority of soap or complex soap thickeners of commercial significance for formulating lubricating greases are metals derived from either alkali or alkaline earth metals. Metallic soap thickeners from transition metal elements, such as titanium, for formulating lubricating greases have been reported in U.S. Pat. No. 5,387,351 of the applicants herein. However, mixed thickener base greases of transition metals like titanium and other metallic soaps have not been reported at all in the literature. However, Applicants have expected that, if mixed soaps based on titanium as one of the components are formed, they may exhibit high performance properties.

BRIEF DESCRIPTION OF THE INVENTION

In accordance with the invention lubricating grease compositions comprise a titanium-based grease combined with a conventional grease, which may be a soap-based grease. The conventional soap greases may be of the sulfonate complex, lithium or lithium complex, aluminum complex or clay-based type.

The grease composition may be formed by combining a titanium compound with an. oil to form a grease product and then adding the other grease component. Additives may also be added. The mixture is then sheared. Greases of NLGI 1-3 characteristics can be obtained.

DETAILED DESCRIPTION OF THE INVENTION

In accordance with this invention a lubricating grease composition comprises a titanium complex grease having 2-20% by weight of titanium alkaoxide, 2-20% by weight of carboxylic acids other than fatty acids, 5-35% by weight of fatty acids, and 0-5% by weight of water; 20-90% by weight of an oil selected from the group consisting of mineral and synthetic oils; 10-60% by weight of sulfonate complex soap/grease; and 0-10% by weight of additives.

In further accordance with this invention the lubricating grease composition may comprise a titanium complex grease having 2-20% by weight of titanium alkaoxide, 2-20% by weight of carboxylic acids other than fatty acids, 5-35% by weight of fatty acids, and 0-5% by weight of water; 20-90% by weight of an oil selected from the group consisting of mineral and synthetic oils; 10-60% lithium base soap/grease; and 0-10% by weight of additives.

Further, this invention covers a lubricating grease composition comprising a titanium complex grease having 2-20% by weight of titanium alkaoxide, 2-20% by weight of carboxylic acids other than fatty acids, 5-35% by weight of fatty acids, and 0-5% by weight of water; 20-90% by weight of an oil selected from the group consisting of mineral and synthetic oils; 10-60% by weight of aluminum complex soap/grease, and 0-10% by weight of additives.

Moreover this invention also extends its scope to a lubricating grease composition comprising a titanium complex grease having 2-20% by weight of titanium alkaoxide, 2-20% by weight of carboxylic acids other than fatty acids, 5-35% by weight of fatty acids, and 0-5% by weight of water; 20-90% by weight of an oil selected from the group consisting of mineral and synthetic oils; 0.5-10% by weight of clay base soap/grease; and 0-10% by weight of additives.

There is further provided according to the invention, a process for the preparation of a lubricating grease composition which comprises the forming of a mix by adding together carboxylic acid and mineral or synthetic oil, stirring and heating such a mix to a temperature of 70 to 100 deg C., adding titanium alkoxide, raising the temperature to 100 to 170 deg. C. to form a thickened grease product, cooling the product, adding 0-2% water thereto and adding the other lubricating grease component at 140 to 60 deg. C., followed by additives and then subjecting the mixture to a shearing step.

In accordance with this invention, a vessel equipped with a 0-150 rpm stirrer is charged with 5 to 25% by weight of fatty acid, 2 to 20% by weight of carboxylic acid, 20 to 90% by weight of mineral or synthetic oil, 2 to 20% titanium alkoxide and 50% of total oil. The mixture is vigorously agitated for 1-2 hrs and vacuum of 300-500 mm Hg is applied to remove volatile components. The temperature of the mixture is then raised to 50-120 deg. C. and is continuously mixed and held at 70-120 deg C. for 1-2 hours, the temperature being raised further very slowly to 120-200 C., maintaining the temperature for 2-6 hours. During this period the product develops a grease structure and converts to a thickened mass. The product is then cooled with continuous stirring to 140-100 deg. C.

and at this stage 0-2% by weight of water is added. The other lubricating grease component is also added at this stage. The mixture is further cooled to 100-70 deg C. followed by addition of additives and sheared with the help of a colloid mill or homogenizer to cause interaction between the titanium-complex soap moiety and the conventional soap moieties leading to synergistic effect and compatibility between the two soaps. The resulting product of NLGI (National Lubricating Grease Institute) type No. 1 to 3 is obtained.

Further according to this invention there is provided a process for the preparation of a lubricating grease composition which comprises the preparation of a mix by adding together fatty acid, carboxylic acid, titanium alkoxide and mineral or synthetic oil, heating such a mixture to a temperature of 160 to 200 deg. C., cooling the resultant mix, adding water thereto and adding another lubricating grease component or its soap described above, stirring the cooled mix and then further cooling the mix and subjecting it to a shearing step.

Further according to this invention a Ti-complex grease is prepared as described above and while cooling at 140-80 deg C. clay either as such or soaked in a base fluid is added in the mixture followed by addition of additives. The mixture is sheared to get a NLGI-type 1-3 consistency product.

In order to describe more fully the nature of the present invention, specific examples will hereinafter be described. It should be understood, that such is by way of illustrative example and is intended neither to delineate nor limit the ambit of the appended claims.

Detailed Description of Illustrative Embodiments

EXAMPLE NO 1

A lubricating grease composition has been prepared consisting of the ingredients with proportions as described below.

| | |
|---|---|
| Phthalic acid | 2-5% |
| Ti-alkoxide | 2-10% |
| Stearic acid | 3-9% |
| Total mineral base oil | 75-85% |
| Li-soap | 2-9% |

A lubricating grease was prepared by the method described above. The lubricating grease thus prepared exhibited the physico-chemical characteristics indicated in Table 1.

TABLE 1

| S. No | Property | ASTM/IP Method | Results |
|---|---|---|---|
| 1 | Penetration at 25 deg C., after 60 strokes | D-217 | NLGI 2 |
| 2 | Drop point, deg C. | D-2265 | 278 |
| 3 | Four ball wear EP test weld load, Kg. | IP-239 | 250 |
| 4 | Four ball wear test 40 Kg, 75 deg C, 1200 rpm & 1 hr, wear scar dia, mm | D-2266 | 0.6 max |
| 5 | Storage life | — | >1 year |

The effectiveness of the lubricating grease composition described above demonstrates its high drop point, good extreme pressure (EP) and antiwear (AW) properties.

EXAMPLE NO 2

This example has lithium complex grease in place of lithium base grease and terephthalic acid in place of phthalic acid. Otherwise all other conditions and ingredients are the same as stated in Example No. 1

The resultant grease exhibited the following physico-chemical characteristics as indicated in Table 2.

TABLE 2

| S. No | Property | Method | Results |
|---|---|---|---|
| 1 | Penetration at 25 deg C., after 60 strokes | D-217 | 278 |
| 2 | Drop point, deg C. | D-566 | 277 |
| 3 | Weld load, Kg | IP-239 | 250 |
| 4 | Wear scar dia, mm | D-2266 | 0.55 |
| 5 | Storage Life | — | >1 year |

This example demonstrates high drop point and good EP/AW properties. This composition has indicated improved results in terms of a wear sear dia. of 0.55 mm compared to 0.6 mm. This composition has exhibited a shelf life in excess of a year.

EXAMPLE NO 3

This example illustrates the preparation of a lubricating grease with ingredients as indicated hereinabove in example 2. Rather, the conventional lubricating grease used is a Ca-sulphonate complex grease and other ingredients are the same as titanium isopropoxide, terephthalic acid, steric acid, mineral base oil and water.

The lubricating grease prepared as per described method and ingredients, without any performance additive, exhibited the following physico-chemical characteristics as set forth in Table-3.

TABLE 3

| S. No | Property | ASTM/IP Method | Results |
|---|---|---|---|
| 1 | Penetration | D-217 | 290 |
| 2 | Drop point, deg C. | D-566 | +290 |
| 3 | Four ball wear test wear scar dia, mm | D-2266 | 0.45 |
| 4 | Four ball EP test weld load, Kg | IP-239 | 315 |

The effectiveness of the lubricating grease composition described above demonstrates its high drop point, excellent EP and AW properties which fulfill the objective of a high performance lubricating grease capable of commercial applications.

EXAMPLE NO 4

This example illustrates the preparation of a lubricating grease with proportions indicated in Example No 1. The polycarboxylic acid used is terephthalic acid, the monocarboxylic acid is stearic acid, the titanium alkoxide is titanium isopropoxide, along with mineral oil and water. The conventional lubricating grease used is aluminium complex The formulated grease by the procedure described above exhibited the following physico chemical characteristics as shown in Table 4.

TABLE 4

| S. No | Property | ASTM/IP Method | Results |
|---|---|---|---|
| 1 | Penetration at 25 deg C. after 60 strokes | D-217 | 320 |
| 2 | Drop point, deg C. | D-2265 | 282 |
| 3 | Weld load, Kg | IP-239 | 250 |

This improved process for making lubricating grease has shown high drop point and good EP properties.

EXAMPLE NO 5

This lubricating grease composition is prepared consisting of the ingredients with the proportions indicated hereinabove. This example consists of commercial titanium isopropoxide, terephthalic acid, stearic acid mineral base oil and water. Conventional clay is added in a 2% concentration and without the use of a binder.

This composition prepared as per procedure described above has the following characteristics as shown in table 5.

TABLE 5

| S. No | Property | ASTM/IP Method | Results |
|---|---|---|---|
| 1 | Penetration at 25 deg C. after 60 strokes | D-217 | 278 |
| 2 | Drop point, deg C. | D-566 | 300 |
| 3 | Weld load, Kg | IP-239 | 250 |
| 4 | WSD, mm | D-2266 | 0.6 |

The effectiveness of such a lubricating grease with clay is shown by good thickening capacity, high drop point, good EP characteristics besides reducing the percentage of soap needed to make a NLGI-2 type grease by 2-3% and without the addition of binding agents such as propylene carbonate.

EXAMPLE NO 6

This lubricating grease composition has the formulation of ingredients as recited in Example No. 2. Conventional EP and AW additives (3%) were added to evaluate the response of additives in this new composition. The resulting composition has exhibited the characteristics in Table 6.

TABLE 6

| S. No | Property | Method | Data |
|---|---|---|---|
| 1 | Penetration | D-217 | 278 |
| 2 | Drop point, deg C. | D-566 | 275 |
| 3 | Weld Load, Kg | IP-239 | 560 |
| 4 | Wear Scar dia, mm | D-2266 | 0.55 |

This composition indicates a synergistic effect of EP and AW additives in terms of improving extreme-pressure anti-wear properties, while the same levels of an additive in a conventional Li-complex grease gives only a 280 Kg weld load.

EXAMPLE NO 7

A further lubricating grease composition is prepared as described in Example No. 2, with the addition of conventional solid lubricants and EP/AW additives to evaluate the response of such solid lubricants along with the EP/AW additives. The resultant composition has exhibited the properties of Table 7.

TABLE 7

| S. No | Property | Method | Data |
|---|---|---|---|
| 1 | Penetration | D-217 | 282 |
| 2 | Drop point, deg C. | D-566 | 270 |
| 3 | Weld Load, Kg | IP-239 | 620 |
| 4 | Wear Scar dia, mm | D-2266 | 0.55 |

This composition exhibits a synergistic response of the additives on EP/AW properties of the grease by increasing weld load from 250 kg to 620 Kg, while the same additive dosage in a conventional Li-base grease increases weld only from 160 kg to 280 kg. This indicates the synergistic response of the additive with this novel thickener.

Conventional soaps/greases that may be used include those listed in the following Table 8.

TABLE 8

| Conventional Soaps/Greases |
|---|
| (i) Lithium-Simple & complex soaps/greases |
| (ii) Aluminium complex soaps/greases |
| (iii) Clay grease |
| (v) Ca-sulphonate complex soaps/greases |

The Comparative synergistic effects and compatibilities of a Ti complex grease with conventional soaps/greases are presented in the following Tables 9 to 14;

Table 9: Test data of a pure Titanium complex grease, such as disclosed in U.S. Pat. No. 5,387,351

Table 10: Test data of Lithium grease vs TiC—Li mixed soap grease

Table 11: Test data of Lithium complex grease vs TiC—LiC mixed soap grease

Table 12: Test data of organoclay based grease vs TiC-Clay mixed soap grease

Table 13: Test data of Aluminium complex grease vs TiC-AlC mixed soap grease

Table 14: Test data of Ca-sulphonate complex grease vs TiC—Ca-sulphonate complex mixed soap grease

TABLE 9

| S. No | Property | ASTM/IP Method | Results |
|---|---|---|---|
| 1. | Penetration at 25° C. after 60 strokes | D-217 | 292 |
| 2. | Drop point, ° C. | D-2265 | 280 |
| 3. | Four ball weld load test, Kg | IP-239 | 250 |

TABLE 9-continued

| S. No | Property | ASTM/IP Method | Results |
|---|---|---|---|
| 4. | Four ball wear test, 40 kg 75° C., 1200 rpm & 1 hr wear scar dia, mm | D-2266 | 0.6 |
| 5 | Storage life | — | <6 months |

The term "c" (e.g. Ti C) references a ϵ-complex grease.

TABLE 10

| S No | Property | ASTM/IP Method | Result (B1) | Result (C1) |
|---|---|---|---|---|
| 1. | Penetration at 25° C. after 60 strokes | D-217 | 285 | 280 |
| 2. | Drop point, ° C. | D-2265/D-566 | 194 | 258 |
| 3. | Four ball weld load test, Kg | IP-239 | 140 | 250 |
| 4. | Four ball wear test, 40 kg 75° C., 1200 rpm & 1 hr wear scar dia, mm | D-2266 | 0.65 | 0.6 |
| 5 | Storage life | — | >1 yr | >1 yr |

Conventional Greases:

Li-(B1), LiC(B2), Clay(B3), AlC(B4), Ca-sulphonate(B5) greases

Mixed Soap Greases

C1: Li-+TiC, C2: LiC-+TiC, C3: clay+TiC, C4: AlC-+TiC and C5: Ca-sulphonate-+TiC

TABLE 11

| S. No | Property | ASTM/IP Method | Result (B2)* | Result (C2)** |
|---|---|---|---|---|
| 1. | Penetration at 25° C. after 60 strokes | D-217 | 280 | 275 |
| 2. | Drop point, ° C. | D-2265 | 260 | 267 |
| 3. | Copper Corrosion as 100° C. after 24 hrs. | IP-112 | Pass | Pass |
| 4. | Water washout characteristics At 80° C., 2 hrs, % wt | D-1264 | 2.4 | 2.2 |
| 5. | Four ball weld load test, Kg | IP-239 | 280 | 280 |
| 6. | Four ball wear test, 40 kg 75° C., 1200 rpm & 1 hr wear scar dia, mm | D-2266 | 0.60 | 0.60 |
| 7 | Storage life | — | >1 yrs | 2 yrs |

*contains EP/AW additives

**does not contain EP/AW additives

TABLE 12

| S. No | Property | ASTM/IP Method | Result (B3) | Result (C3) |
|---|---|---|---|---|
| 1. | Penetration at 25° C. after 60 strokes | D-217 | 280 | 286 |
| 2. | Drop point, ° C. | D-2265 | 280+ | 280+ |
| 3. | Four ball weld load test, Kg | IP-239 | 180. | 250 |
| 4. | Four ball wear test, 40 kg 75° C., 1200 rpm & 1 hr wear scar dia, mm | D-2266 | 0.60 | 0.55 |
| 5 | Storage life | — | >1 yr | >1 yr |

TABLE 13

| S. No | Property | ASTM/IP Method | Result (B4) | Result (C4) |
|---|---|---|---|---|
| 1. | Penetration at 25° C. after 60 strokes | D-217 | 278 | 277 |
| 2. | Drop point, ° C. | D-2265 | 266 | 277 |
| 3. | Four ball weld load test, Kg | IP-239 | 250 | 280 |
| 4. | Four ball wear test, 40 kg 75° C., 1200 rpm & 1 hr wear scar dia, mm | D-2266 | 0.60 | 0.6 |
| 5 | Storage life | — | >1 yr | >1 yr |

TABLE 14

| S. No | Property | ASTM/IP Method | Result (B5) | Result (C5) |
|---|---|---|---|---|
| 1. | Penetration at 25° C. after 60 strokes | D-217 | 280 | 275 |
| 2. | Drop point, ° C. | D-2265 | 303 | 289 |
| 3. | Four ball weld load test, Kg | IP-239 | 400 | 250 |
| 4. | Four ball wear test, 40 kg 75° C., 1200 rpm & 1 hr wear scar dia, mm | D-2266 | 0.50 | 0.60 |
| 5 | Storage life | — | >1 yr | >1 yr |

Mineral Oils/Synthetic Oils Used in the Invention:

The mineral oils and synthetic oils or mixtures thereof can be used depending upon the particular grease being prepared, as known in the art. Mineral oil used in preparing the greases can be any conventionally refined base stock derived from paraffinic, naphthaneic and mixed base crudes. Synthetic oils that can be used include synthetic hydrocarbons such as poly-alphaolefins.

Additives Used in the Invention:

The extreme pressure and antiwear additives, structure modifiers additives and solid lubricants additives can be selected from one or more of the following:

EP/AW additives: (i.) substituted dimercapto-thiadiazole; (ii.) antimony dialkyl dithiocarbamate, (iii.) Zn diisopropyl dithiophosphate tetra-methylenediamine; and (iv). sulphurized fat Structure Modifiers: (i.) Methacrylate-styrene copolymer; and (ii) ethylene-propylene copolymers grafted with glycidyl methacrylates.

Solid Lubricants: (i.) Colloidal graphite; (ii.) Molybdenum disulphide

Carboxylic Acids Used in the Invention:

TABLE 15

| S. No. | Carboxylic acid | Structure |
|---|---|---|
| 1. | Tartaric acid | — |
| 2. | Citric acid | — |
| 3. | Salicylic acid | $C_6H_4(OH)COOH$ |
| 4. | Phthalic acid (ortho-benzene dicarboxylic acid) | $C_6H_4(COOH)_2$ |
| 5. | Terephtalic acid (para-benzene dicarboxylic acid) | $C_6H_4(COOH)_2$ |
| 6. | Cinnamicacid | $C_6H_5CH{=}CH{-}COOH$ |

Titanium Alkoxides Used in the Invention:

Titanium alkoxides used in the invention are alkoxides of $C_3$ to $C_6$ alcohols having a titanium metal content of approximately 17% by weight, e.g. titanium isopropoxide.

Clays Used in the Invention:

Bentonite and hectorite are most widely used clays for the manufacture of clay greases.

Fatty Acids Used in Invention:

The sources of fatty acids employed in this invention are alkyl carboxylic acids from vegetable sources, which may have few double bonds in the structure. They may include stearic acid, hydroxystearic acid, oleic acid, mahuwa oil, etc.

We claim:

1. A process for preparing a lubricating grease composition comprising titanium complex grease which consists of 2-20% by weight of titanium alkaoxide, 2-20% by weight of carboxylic acids other than fatty acids, 5-35% by weight of fatty acids, 0-5% by weight of water, 20-90% by weight of an oil selected from the group consisting of mineral and synthetic oils and 10-60% by weight of conventional soap/grease and 0-10% by weight of additives, comprising the steps of:

(a) charging a vessel equipped with a 0-150 rpm stirrer with 5 to 35% by weight of fatty acid, 2 to 20% by weight of carboxylic acid, 20 to 90% by weight of mineral or synthetic oil, 2 to 20% titanium alkoxide and 50% of total oil;

(b) agitating the mixture so obtained vigorously for 1-2 hours under a vacuum of 300-500 mm Hg to remove volatile components;

(c) raising the temperature of the mixture so obtained to 50-120° C. and continuously mixing at 70-120° C. for 1-2 hours, followed by further raising the temperature very slowly to 120-200° C., maintaining this temperature for 2-6 hours resulting in a product having grease structure and a thickened mass;

(d) cooling the product so obtained with continuous stirring to a temperature between 140 to 100° C., adding 0-2% by weight of water and said conventional soap/grease at this stage to the mixture; and (e) further cooling the mixture so obtained to 100-70° C. followed by the addition of the additives and shearing the mixture with the help of a colloid mill or homogenizer.

* * * * *